US006266841B1

(12) United States Patent
Cho

(10) Patent No.: US 6,266,841 B1
(45) Date of Patent: Jul. 31, 2001

(54) AUTOMATIC ERASING DEVICE FOR ERASING CHALK MARKS ON A WRITING BOARD BY WATER

(75) Inventor: Ming-Pao Cho, Kaohsiung Hsien (TW)

(73) Assignee: Huey Yeau Co., LTD, Kaohsiung Hsien (TW)

( * ) Notice: Subject to any disclaimer, the term of this patent is extended or adjusted under 35 U.S.C. 154(b) by 0 days.

(21) Appl. No.: 09/552,291

(22) Filed: Apr. 19, 2000

(30) Foreign Application Priority Data

Apr. 21, 1999 (TW) ..... 088206210

(51) Int. Cl.[7] ..... A47L 11/38

(52) U.S. Cl. ..... 15/246; 15/21.1; 15/97.1; 434/411; 434/417

(58) Field of Search ..... 15/21.1, 97.1, 15/102, 246; 434/411, 412, 413, 417

(56) References Cited

U.S. PATENT DOCUMENTS 5,319,820 * 6/1994 Forst ..... 15/246
5,649,828 * 7/1997 Kawashima ..... 434/411
6,073,297 6/2000 Lee .

FOREIGN PATENT DOCUMENTS

1059272 * 7/1979 (CA) ..... 15/97.1
0656881 * 4/1979 (SU) ..... 434/411

* cited by examiner

*Primary Examiner*—Randall E. Chin
(74) *Attorney, Agent, or Firm*—Brinks Hofer Gilson & Lione

(57) ABSTRACT

An automatic erasing device is used for erasing chalk marks on a writing board, and includes an erasing mechanism having an elongated housing disposed frontwardly of and slidable relative to the writing board along a longitudinal axis. The housing extends in a transverse axis relative to the longitudinal axis, and has a rear wall formed with an elongated rear opening to confront the writing board, and a lower portion formed with a water tank. An eraser unit is disposed within the elongated housing, and is biased to protrude outwardly and rearwardly of the rear wall via the elongated rear opening for abutting against the writing board. The eraser unit is connected to the water tank in such a manner that water flows from the water tank into the eraser unit so as to soak the eraser unit while the eraser unit moves on the writing board.

4 Claims, 9 Drawing Sheets

AUTOMATIC ERASING DEVICE FOR ERASING CHALK MARKS ON A WRITING BOARD BY WATER

BACKGROUND OF THE INVENTION

1. Field of the Invention

The invention relates to an erasing device, more particularly to an automatic erasing device for erasing chalk marks from a writing board by water.

2. Description of the Related Art

Referring to FIGS. 1 and 2, in co-pending U.S. patent application Ser. No. 09/170,942 filed by the applicant, now U.S. Pat. No. 6,073,297 an automatic erasing device 1 is disclosed to include an erasing mechanism adapted to be mounted on a writing board 10 for erasing chalk marks on the writing board 10. The writing board 10 has left and right end portions that extend in a longitudinal axis thereof and an intermediate portion between the left and right end portions.

As illustrated, the erasing mechanism includes an elongated housing 11 disposed frontwardly of and slidable relative to the writing board 10. The elongated housing 11 extends in a transverse axis relative to the longitudinal axis, and has upper and lower portions, a rear wall formed with an elongated rear opening 111 to confront the writing board 10, a front wall and an accommodating space 13 defined between the front and rear walls, and between the upper and lower portions. The elongated rear opening 111 extends from the upper portion to the lower portion. Upper and lower axles 132 are journalled in the elongated housing 11 proximate to the upper and lower portions, respectively. The axles 132 extend parallel to the longitudinal axis. A transmitting belt 133 is trained on the upper and lower axles 132 under tension, and is rotated upon rotation of the upper and lower axles 132 for movement along a rear route proximate to and in alignment with the elongated rear opening 111, and a front route parallel to the rear route and distal to the elongated rear opening 111. A plurality of eraser members 134 are disposed detachably on, and are spaced apart from one another along a circumferential outer surface of the transmitting belt 133. Each of the eraser members 134, when moving along the rear route, protrudes outwardly and rearwardly of the rear wall via the elongated rear opening 111 and is adapted to abut against the writing board 10. A driving motor 131 is disposed to drive either one of the upper and lower axles 132 so as to move the eraser members 134 along the front and rear routes. The elongated housing 11 is driven to move reciprocally in the longitudinal axis between the left and right end portions of the writing board 10, and is biased by two biasing units 17 toward the writing board 10 while the elongated housing 11 is being moved reciprocally in the longitudinal axis. Each of the biasing units 17 includes a shaft 170 disposed transversely between left and right walls of the elongated housing 11 and guided to move in an urging direction towards the rear opening 111, a roller 171 rotatably mounted on the shaft 170 by means of a screw 173, and a spring member 174 mounted by means of a spring retention unit 172 to bias the shaft 170 to move in the urging direction so as to bring the roller 171 to abut against the transmitting belt 133. An additional biasing unit 12 is provided to enhance contact between the eraser members 134 and the writing board 10 when the eraser members 134 are aligned with the rear opening 111 in the elongated housing 11. Preferably, the front wall of the elongated housing 11 is provided with a plurality of spaced scrubbing brushes 15 thereon in alignment with and capable of scrubbing the eraser members 134 when the latter are moved along the front route. The housing 11 further has a detachable front cover 14, and a dustbin 16 provided at the lower portion thereof and in communication with the accommodating space 13 by a connecting pipe 161 for collecting the chalk powder that results when the chalk marks are erased by the eraser members 134.

Some of the disadvantages that result from the use of the aforesaid erasing device 1 are as follows:

(i) The eraser members 134, though scrubbed by the brushes 15, can not wipe the chalk marks thoroughly from the writing board 10 after long term use. The chalk marks more or less adhere on the eraser members 134, thereby resulting in a poor wiping effect.

(ii) Constant rubbing of the accumulated chalk on the eraser member 134 against the writing board 10 may hinder smooth reciprocal movement of the elongated housing 11 along the longitudinal direction, and subsequently result in the generation of noise.

SUMMARY OF THE INVENTION

Therefore, the object of this invention is to provide an automatic erasing device that can erase chalk marks on a writing board by water and that Is clear of the aforementioned disadvantages.

Accordingly, an automatic erasing device of the present invention is used for erasing chalk marks on a writing board, which has left and right end portions extending in a longitudinal axis thereof and an intermediate portion between the left and right end portions. The automatic erasing device includes an erasing mechanism consisting of an elongated housing, and an eraser unit. The housing is adapted to be disposed frontwardly of and slidable relative to the writing board, and extends in a transverse axis relative to the longitudinal axis. The housing has an upper portion, a lower portion formed with a water tank that is adapted to receive water therein, and a rear wall formed with an elongated rear opening to confront the writing board. The rear opening extends from the upper portion to the lower portion of the housing. The eraser unit is disposed within the housing, and is biased to protrude outwardly and rearwardly of the rear wall via the rear opening and to abut against the writing board. The eraser unit is connected to the water tank in such a manner that water flows from the water tank into the eraser unit so as to soak the eraser unit while the eraser unit is adapted to move on the writing board. The housing is driven to move reciprocally in the longitudinal axis between the left and right end portions of the writing board.

BRIEF DESCRIPTION OF THE DRAWINGS

Other features and advantages of this invention will become more apparent in the following detailed description of the preferred embodiments of this invent on, with reference to the accompanying drawings, in which.

DETAILED DESCRIPTION OF THE PREFERRED EMBODIMENTS

Figure 1:
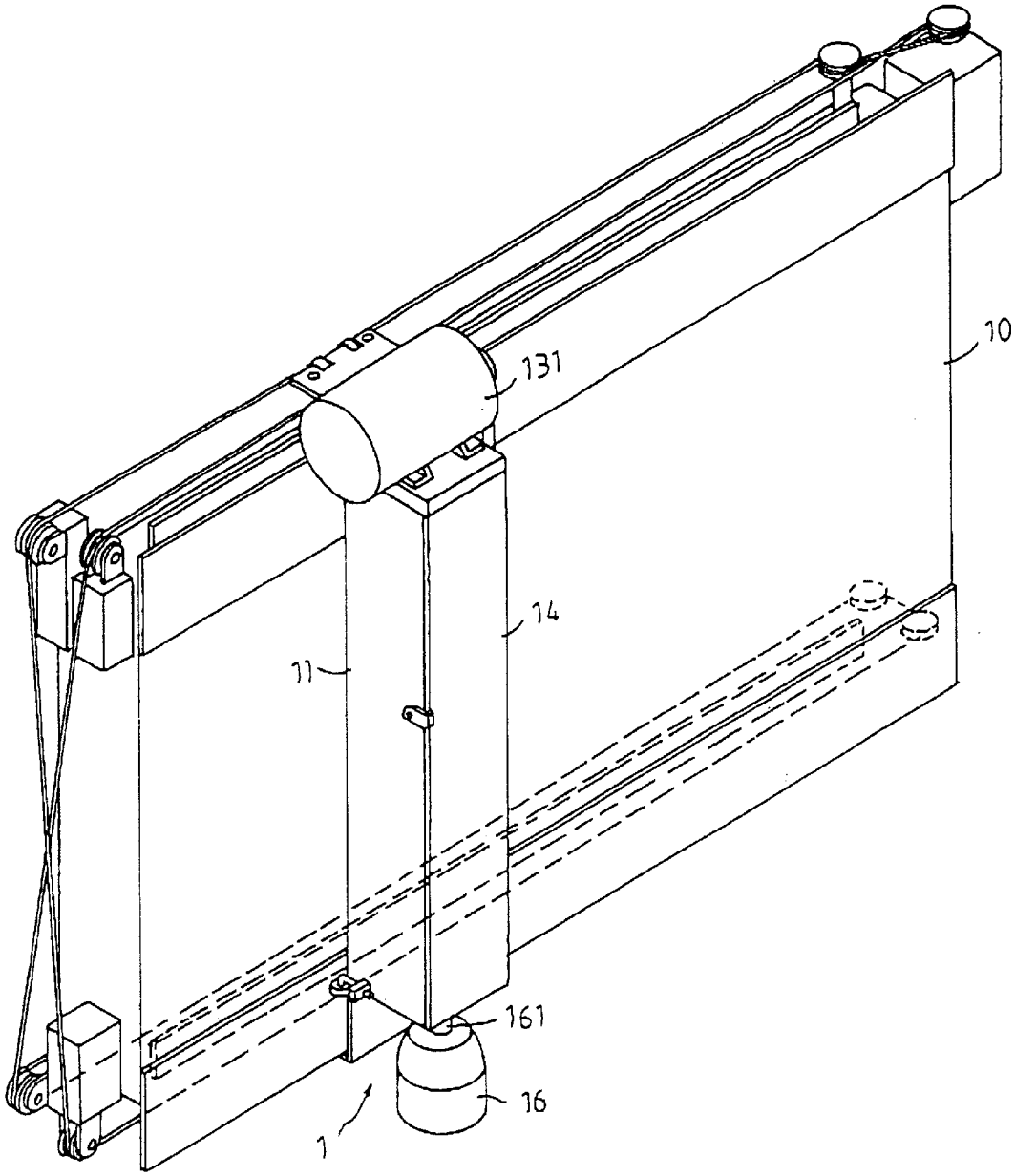
FIG. 1 is a perspective view of an automatic erasing device disclosed in co-pending U.S. patent application Ser. No. 09/170,942, now U.S. Pat. No. 6,073,297 when mounted on a writing board for erasing chalk marks.
Figure 2:
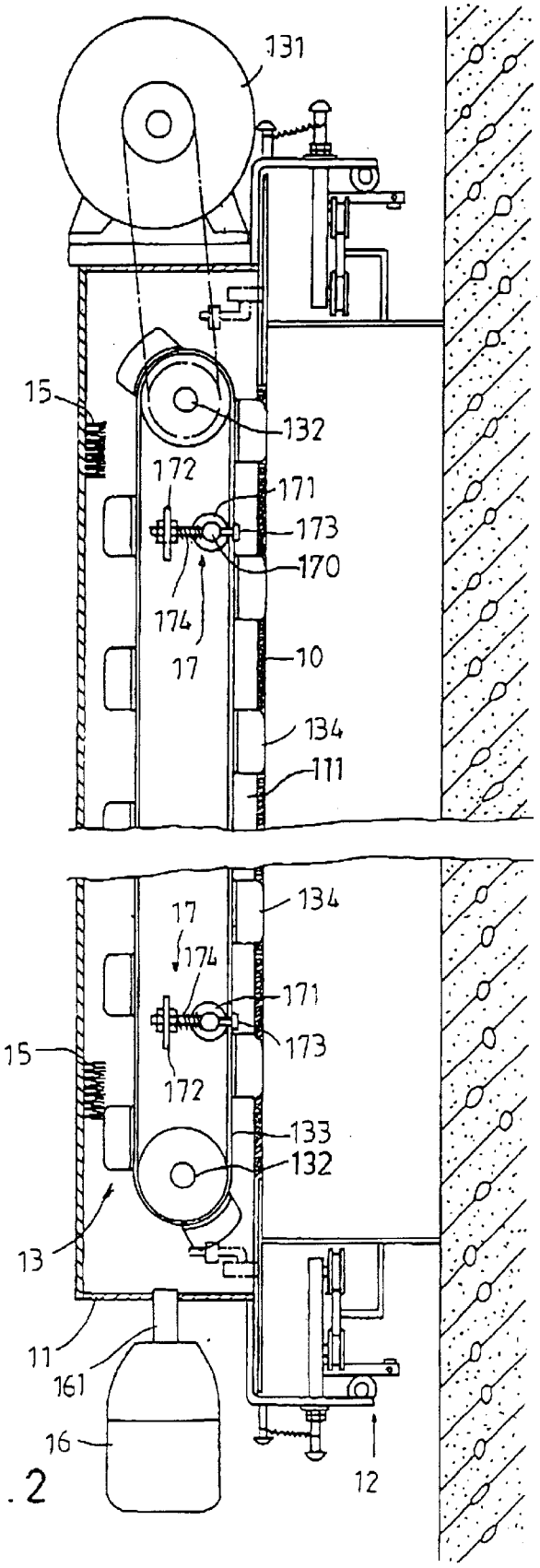
FIG. 2 is a fragmentary sectional view of the erasing device shown in FIG. 1 when mounted on the writing board.
Figure 3:
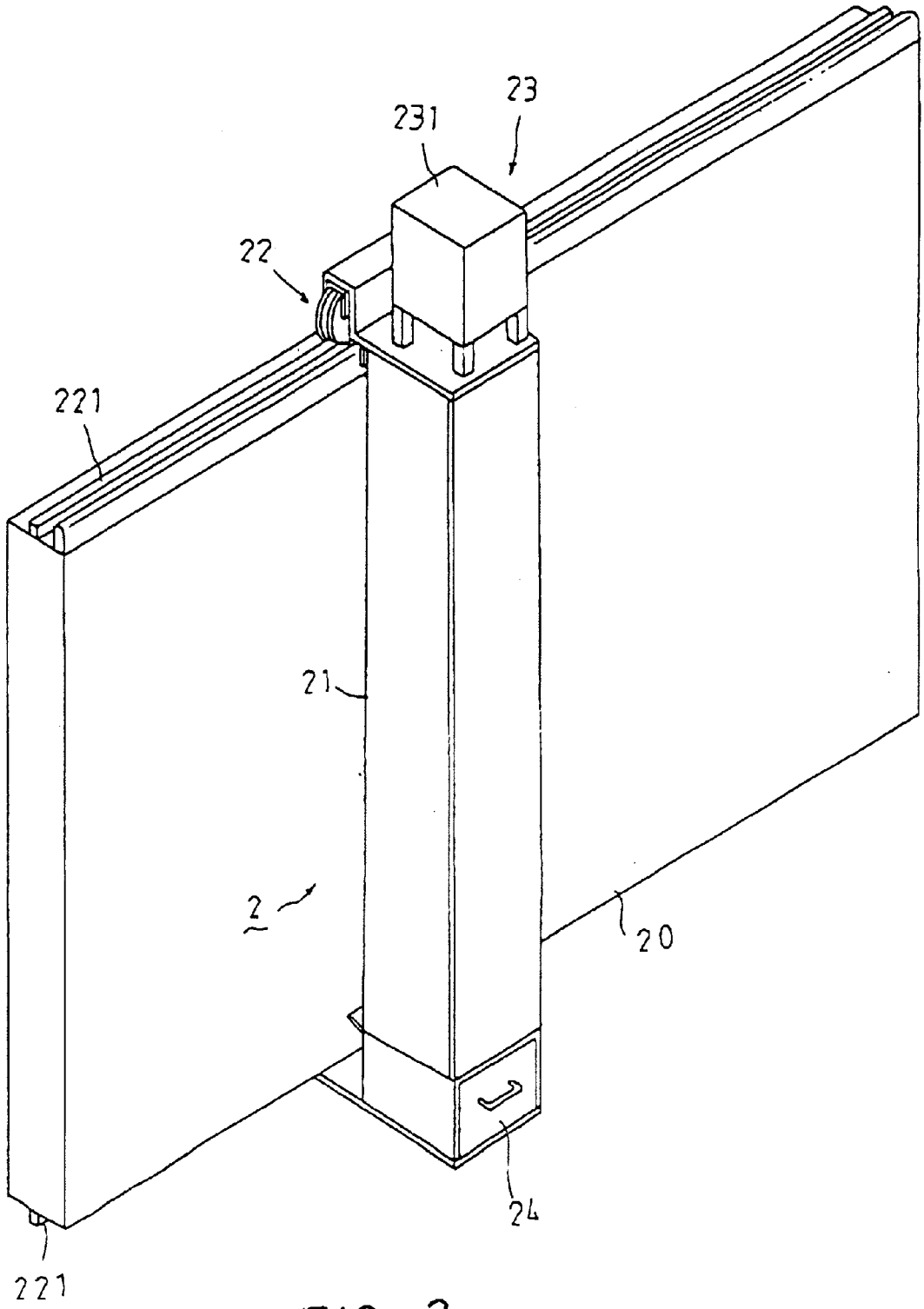
FIG. 3 is a perspective view of a first preferred embodiment of an automatic erasing device according to the present invention when mounted on a writing board for erasing the chalk marks on the writing board.
Figure 4:
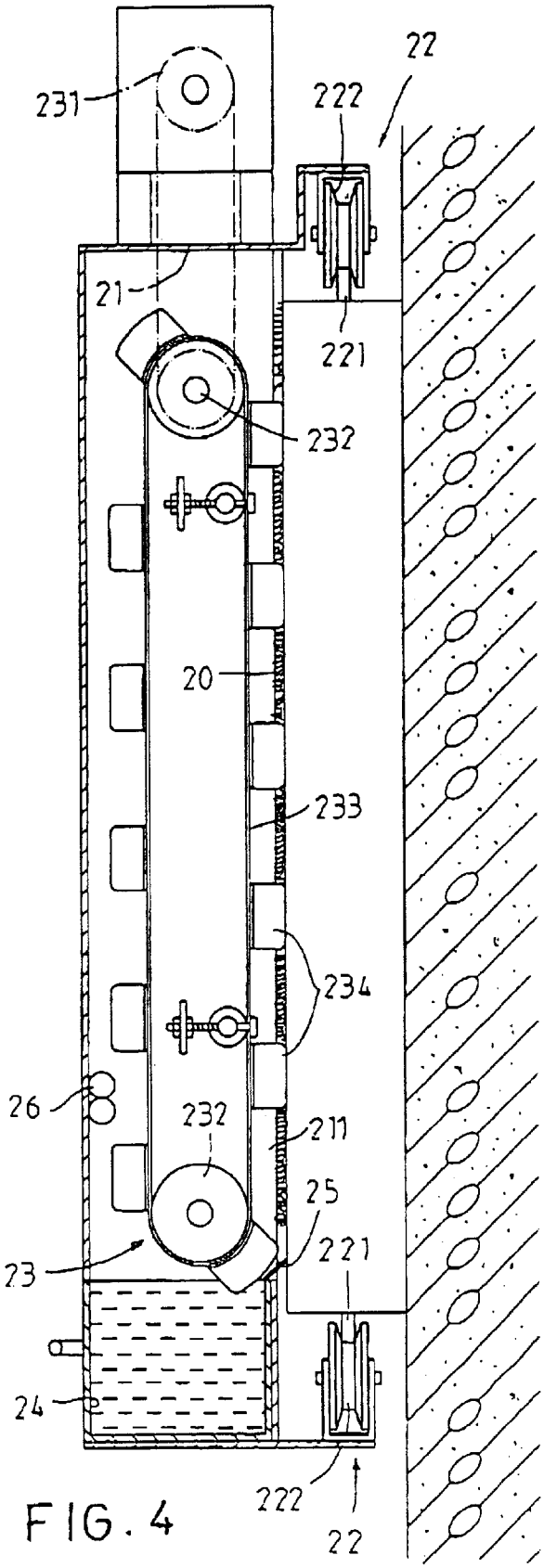
FIG. 4 is a sectional view of the first preferred embodiment when mounted on the writing board.

Referring to FIGS. 3 and 4, the first preferred embodiment of an automatic erasing device 2 of this invention is shown to be mounted on a writing board 20 for erasing chalk marks thereon. The first preferred embodiment includes an erasing mechanism with an elongated housing 21, an eraser unit including a plurality of eraser members 234, upper and lower axles 232, a transmitting belt 233, and a driving motor 231

As illustrated, the writing board 20 has left and right end portions that extend in a longitudinal axis, and an intermediate portion between the left and right end portions. The elongated housing 21 is disposed frontwardly of and is slidable relative to the writing board 20. The housing 21 extends in a transverse axis relative to the longitudinal axis, and has an upper portion 22, a lower portion 22 formed with a water tank 24 that is adapted to receive water therein, a removable front wall and a rear wall formed with an elongated rear opening 211 to confront the writing board 20 such that the rear opening 211 extends from the upper portion to the lower portion. The housing 21 is provided with two pulleys 222 at the upper and lower portions 22 thereof. The pulleys 222 are trailed on two longitudinal rails 221 fixed on top and bottom ends of the writing board 20 to facilitate sliding movement of the housing 21 in the longitudinal axis.

The axles 232 are journalled in the housing 21 proximate to the upper and lower portions 22, respectively. The axles 232 extend parallel to the longitudinal axis.

The transmitting belt 233 is trained on the axles 232 under tension so as to be rotated upon rotation of the axles 232. The transmitting belt 233 is movable along a rear route that is proximate to and in alignment with the elongated rear opening 211, and a front route that is parallel to the rear route and distal to the elongated rear opening 211.

The eraser members 234 are disposed detachably on, and are spaced apart from one another along a circumferential outer surface of the transmitting belt 233. Each of the eraser members 234, when moving along the rear route, protrudes outwardly and rearwardly of the rear wall via the elongated rear opening 211 to abut against the writing board 20.

The driving motor 231 is operably connected to and drives the axles 232 so as to move the eraser members 234 along the front and rear routes. The driving motor 231 further drives the elongated housing 21 via a transmission device (not shown) to move reciprocally in the longitudinal axis between the left and right end portions of the writing board 20. The eraser members 234 are connected to the water tank 24 in such a manner that water flows from the water tank 24 into the eraser members 234 when the latter leave the rear route so as to be entrained on the eraser members 234 such that the writing board 20 is wiped by the eraser members 234 soaked with water. Since the lower axle 232 is disposed over the water tank 24, each of the eraser members 234 moves into the water in the water tank 24 when moved to be disposed under the lower axle 232.

A biasing unit is employed to bias the elongated housing 21 toward the writing board 20 while the elongated housing 21 is being moved reciprocally in the longitudinal axis of the writing board 20. Since the structure of the biasing unit is similar to that disclosed in the aforesaid co-pending U.S. Patent application, a detailed structure of the biasing unit will be omitted herein for the sake of brevity.

In the first preferred embodiment, a water removing member 26, in the form of rollers, is disposed on the front wall of the elongated housing 21 to abut against the eraser members 234 when the latter move along the front route. Under such a condition, a portion of the water from the eraser members 234 is removed. Preferably, an inclined water guiding plate 25 is disposed at an uppermost end of the water tank 24 and abuts against the writing board 20 so as to receive water, which flows downward on the writing board 20.

Figure 5:
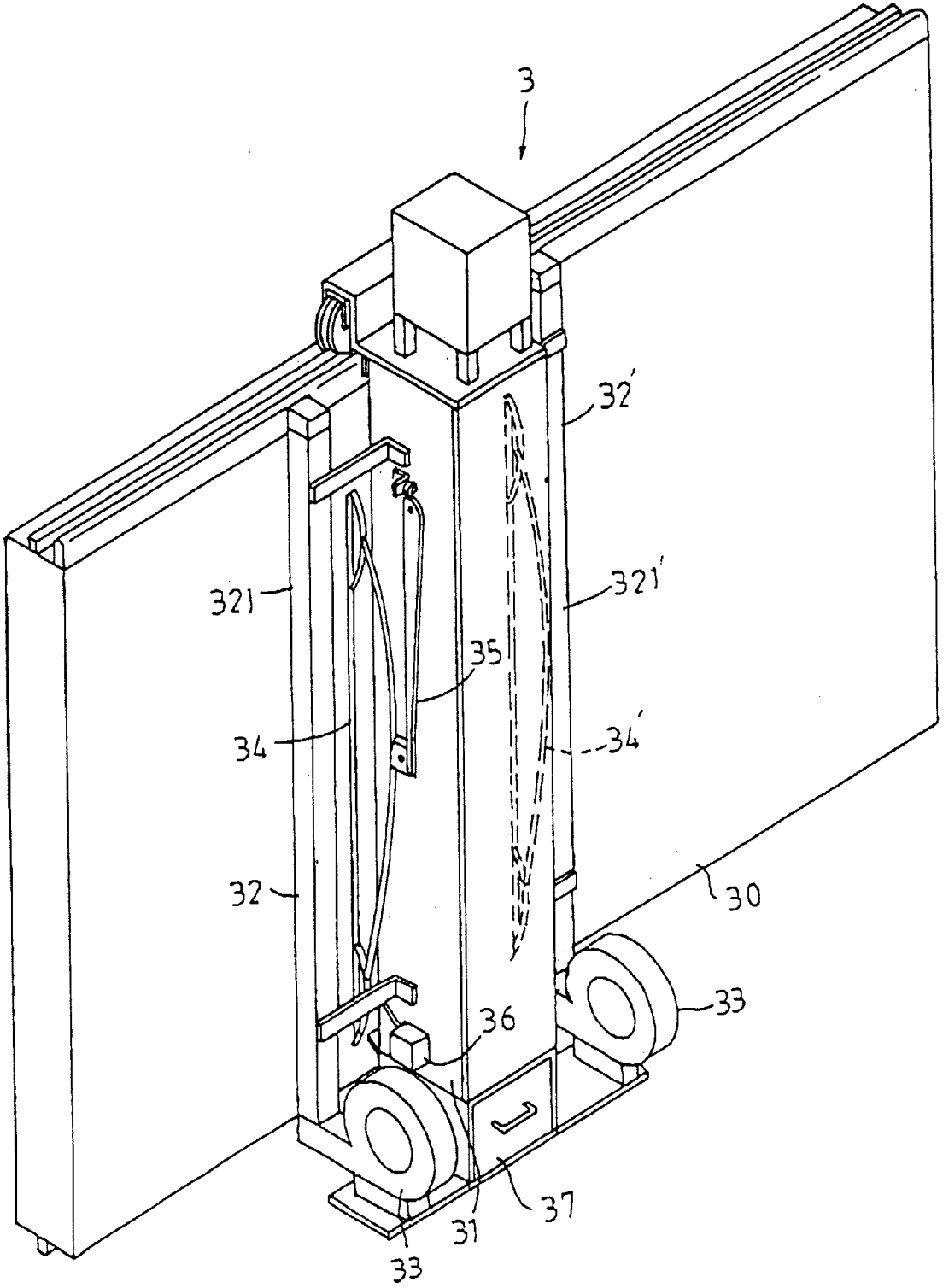
FIG. 5 is a perspective view of a second preferred embodiment of an automatic erasing device according to the present invention when mounted on a writing board for erasing the chalk marks or the writing board.

Referring to FIG. 5, a second preferred embodiment 3 of the present invention is shown to have a structure similar to that of the first preferred embodiment, except for two water wipers units 34,34' and two dryer units 32,32'. The water wiper units 34,34' are mounted respectively on left and right sides of the elongated housing 31 by means of two connecting rods 35 while the dryer units 32,32' are mounted respectively on left and right sides of the elongated housing 31 outboard to the water wiper units 34, 34'. The wiper units 34, 34' slide over the writing board 30 for removing water therefrom. The dryer units 32,32' blow hot air onto the writing board 30 for vaporizing water on the writing board 30. Each of the dryer units 32,32' includes an elongated casing 321,321' disposed slidably on the housing 31, and a hot air pipe (not visible) embedded within the casing 321, 321' and formed with a plurality of hot air outlets oriented towards the writing board 30 via the rear opening. A wiper control 36 is disposed on the housing 31 at an elevation above the water tank 37 for actuation of the connecting rods 35 at desired intervals.

Figure 6:
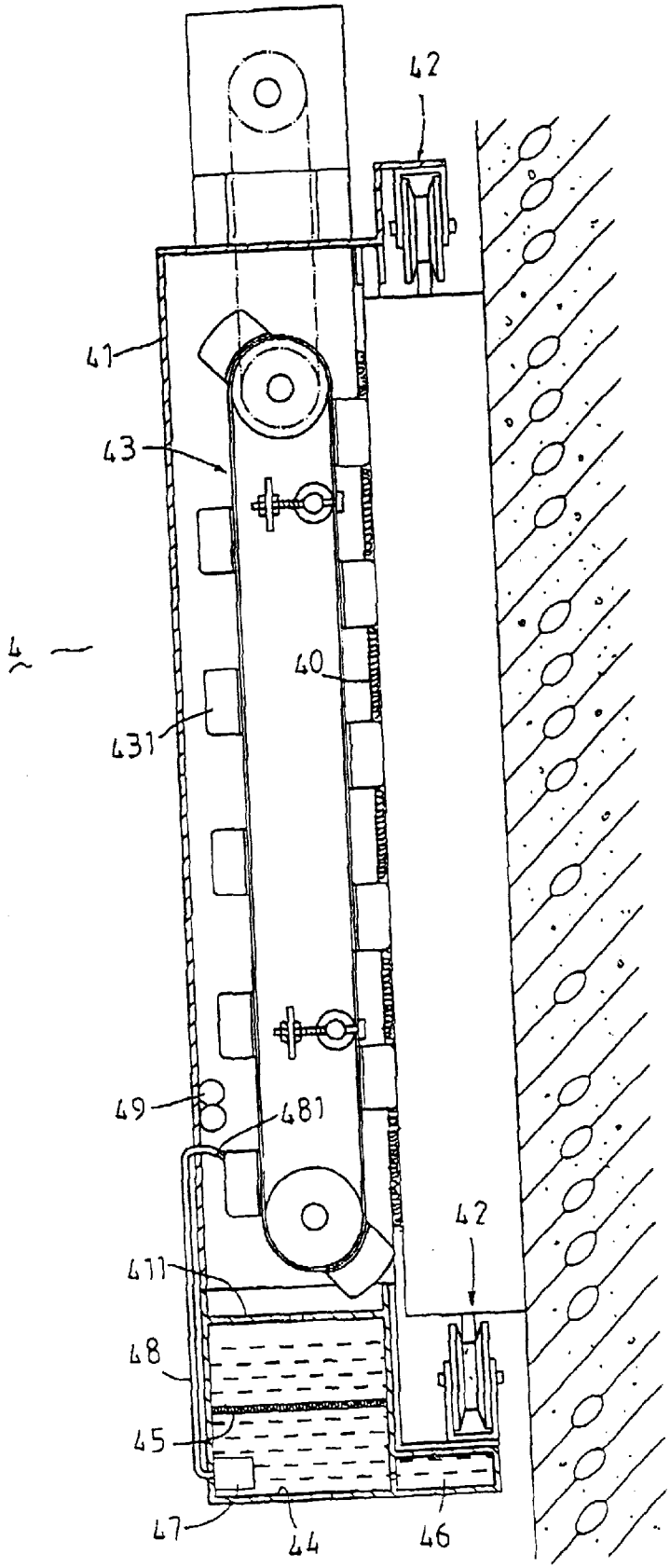
FIG. 6 is a sectional view of a third preferred embodiment of an automatic erasing device according to the present invention when mounted on a writing board for erasing the chalk marks on the writing board.

Referring to FIG. 6, a third preferred embodiment 4 of the present invention is shown to have a structure similar to that of the first embodiment except for the addition of a water suction unit. The water suction unit is provided for supply of water from the water tank 44 to the eraser members 431 in the eraser mechanism 43. The suction unit includes a water tube 48 that is disposed on the elongated housing 41 and that has a lower end connected to the water tank 44 via a pump 47, and an upper end 481 terminating adjacent to the front route. During operation and when the eraser members 431 move along the front route, the pump 47 forces the water from the water tank 44 into the eraser members 431 via the water tube 48. A water supply tank 46 is provided adjacent to and in communication with the water tank 44 for supply of water to the latter. Preferably, a chalk filter sheet 45 is disposed transversely in the water tank 44 for sieving the chalk powder so that the water forced out by the pump 47 is clear of chalk powder Preferably, a perforated scrub plate 411 is immersed in the water tank 44 above the filter sheet 45 to scrub against the eraser members 431 when the latter are immersed in water by virtue of the rotation of the transmitting belt. A water removing member 49 is disposed above the water tube 48 to abut against the eraser members 431 for removal of a portion of the water from the eraser members 431 when the latter move along the front route. Two pulleys are mounted on the upper and lower portions 42 of the housing 41 in a manner similar to the first preferred embodiment for ease movement of the housing 41 in the longitudinal axis of the writing board 40.

Figure 7:
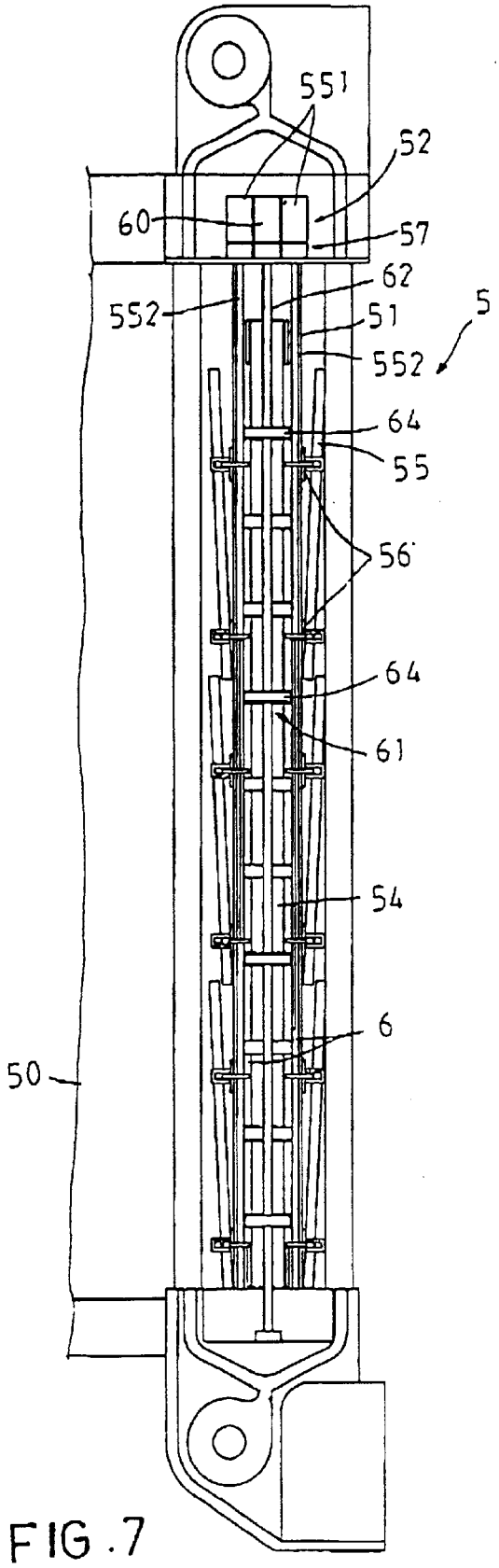
FIG. 7 is a fragmentary schematic view of a fourth preferred embodiment of an automatic erasing device according to the present invention when mounted on a writing board for erasing the chalk marks on the writing board.
Figure 8:
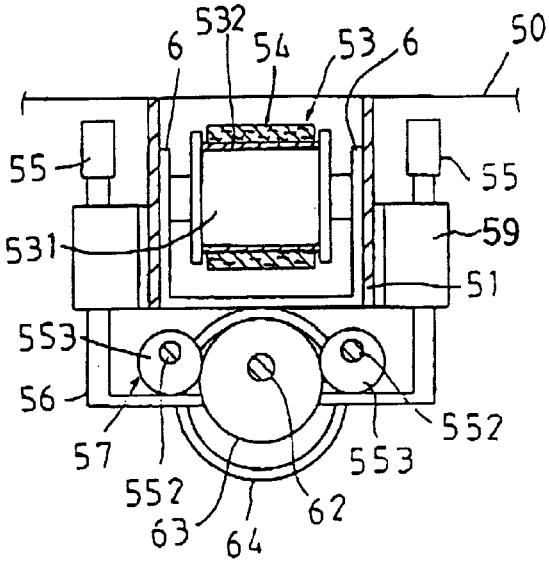
FIG. 8 is a fragmentary sectional view of the fourth preferred embodiment, illustrating a state where the eraser members and the wipers employed therein are separated from the writing board.
Figure 9:
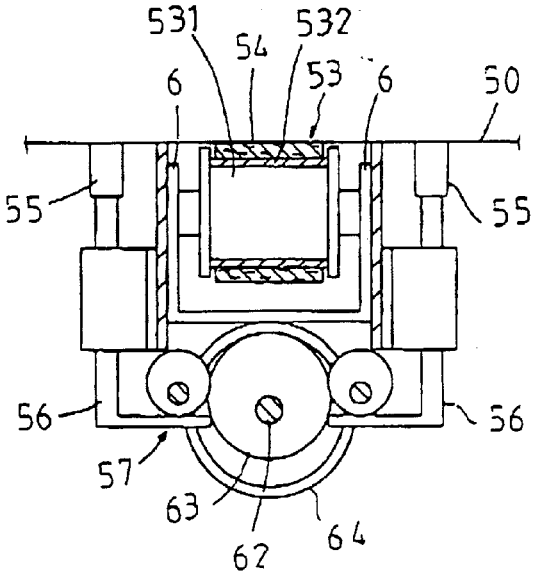
FIG. 9 is a fragmentary sectional view of the fourth preferred embodiment, illustrating a state where the eraser members and the wipers employed therein abut against the writing board.

Referring to FIGS. 7, 8 and 9, a fourth preferred embodiment of the present invention is shown to have a structure similar to that of the first embodiment, except for the addition of an eraser-pressing unit 61 and a wiper-pressing unit 52. In this embodiment, the front wall is removed from the elongated housing 51. The eraser-pressing unit 61 includes a follower frame 6 of U-shaped cross section and having two parallel lateral walls that abut respectively against opposite lateral walls of the elongated housing 51, a middle driving source 60 mounted on the topmost portion of the housing 51, and a driving shaft 62. Upper and lower axles 531 are journalled within the follower frame 6 proximate to the upper and lower portions of the elongated housing 51 such that axles 531 extend parallel to the longitudinal axis A transmitting belt 532 is trained on the upper and lower axles 531. An eraser unit 53 includes a plurality of eraser members 54, which are disposed on the transmitting belt 532. An eccentric wheel unit 57 includes three spaced-apart eccentric wheels 63, 553, each of which is mounted eccentrically on the driving shaft 62. A plurality of anti-wear rings 64 are sleeved rotatably on the wheels 63 and have a peripheral surface that contacts the follower frame 6. The shaft 552 is coupled to the driving source 60 and can be rotated by the same. Under such a condition, rotation of the eccentric wheel 63 will cause reciprocating movement of the frame 6 within the housing 51 in a frame-moving direction perpendicular to the writing board 50. Thus, the frame 6 is movable between an erasing position shown in FIG. 9, where the soaked eraser members 54 on the rear route abut against the writing board 50, and a non-erasing position shown in FIG. 8, where the eraser members 54 are separated from the writing board 50. The wiper-pressing unit 52 includes two follower rod units connected fixedly to two water wipers 55, respectively, and two guiding sleeve units 59 mounted fixedly on the elongated housing 51 and around the follower rod units respectively so as to guide the latter relative to the housing 51 in the frame-moving direction. As such, when the shaft 552 rotates, the follower rod units reciprocate in the frame-moving direction between a wiping position shown in FIG. 9, where the water wipers 55 abut against the writing board 50, and a non-wiping position shown in FIG. 8, where the wipers 55 separate from the writing board 50. Two side driving sources 551 are disposed on two sides of the middle driving source 60 for rotating two driving shafts 552, respectively. Each of the follower rod units consists of a plurality of L-shaped follower rods 56, each of which contacts an outer periphery of an eccentric wheel 553 that is sleeved fixedly on the driving shaft 552.

Figure 10:
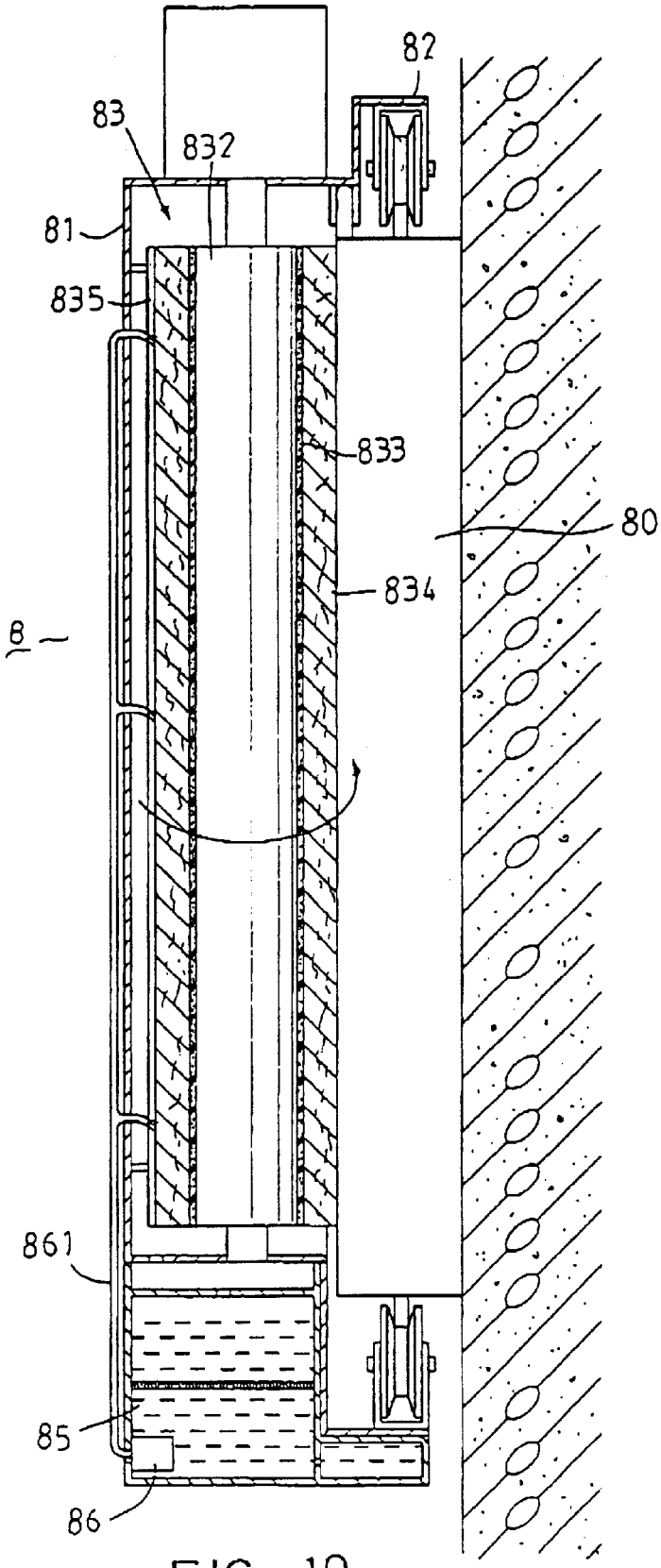
FIG. 10 is a fragmentary sectional view of a fifth preferred embodiment of an automatic erasing device according to the present invention when mounted on a writing board for erasing the chalk marks on the writing board.

Referring to FIG. 10, a fifth preferred embodiment 8 of the present invention is shown to have an erasing mechanism 83 different from those of the previous embodiments. As shown, an elongated housing 81 is disposed frontwardly of and is slidable in the longitudinal direction relative to the writing board 80 by means of two pulleys 82. A driving shaft 832 is journalled within the housing 81 in such a manner teat the shaft 832 extends in the transverse axis of the writing board 80. A tubular band 833 is sleeved fixedly on the shaft 832. A tubular erasing felt 834 is sleeved fixedly on the band 833. A water tube 861 is mounted on the housing 81, and has a lower end that extends into the water in the water tank 85, and an upper end that is directed to the felt 834 so as to force the water in the water tank 85 into the felt 834 by means of a pump 86. A water removing member 835 is attached on the front wall of the housing 81, and abuts against the felt 834 for removing a portion of the water within the felt 834 when the shaft 832 rotates in the elongated housing 81.

As illustrated above, the automatic erasing device of this invention can avoid pollution of the air when in use, and since water is employed in the erasing operation of the writing board, hygienic conditions of the latter and the immediate surrounding can be ensured. The objects of this invention are thus achieved.

With this invention thus explained, it is apparent that numerous modifications and variations can be made without departing from the scope and spirit of this invention. It is therefore intended that this invention be limited only as indicated in the appended claims.

I claim:

1. An automatic erasing device for erasing chalk marks on a writing board, the writing board having left and right end portions that extends in a longitudinally axis thereof and an intermediate portion between the left and right end portions, said automatic erasing device comprising:

an erasing mechanism including an elongated housing adapted to be disposed frontwardly of and slidable relative to the writing board, said elongated housing extending in a transverse axis relative to the longitudinal axis, and having an upper portion, a lower portion formed with a water tank that is adapted to receive water, and a rear wall formed with an elongated rear opening to confront the writing board and extending from said upper portion to said lower portion;

an eraser unit disposed in said elongated housing, and biased to protrude outwardly and rearwardly of said rear wall via said elongated rear opening, and adapted to abut against the writing board, said eraser unit being connected to said water tank in such a manner that water flows from said water tank into said eraser unit so as to soak said eraser unit while said eraser unit is adapted to move on the writing board; and means for driving said elongated housing to move reciprocally in the longitudinal axis between the left and right end portions of the writing board;

said erasing mechanism further includes:

upper and lower axles journalled in said elongated housing proximate to said upper and lower portions, respectively, each of said upper and lower axles extending parallel to the longitudinal axis;

a transmitting belt trained on said upper and lower axles under tension so as to be rotated upon rotation of said upper and lower axles, said transmitting belt being movable along a rear route proximate to and in alignment with said elongated rear opening, and a front route parallel to said rear route and distal to said elongated rear opening;

said eraser unit including a plurality of eraser members disposed detachably on, and spaced apart from one another along a circumferential outer surface of said transmitting belt, each of said eraser members, when moving along said rear route, protruding outwardly and rearwardly of said rear wall via said elongated rear opening and being adapted to abut against the writing board, said eraser members being connected to said water tank in such a manner that water flows from said water tank into said eraser members, while said eraser members leave said rear route, so as to be entrained on said eraser members when said eraser members are adapted to move on the writing board; and a driving motor disposed to drive either one of said upper and lower axles so as to move said eraser members along said front and rear routes.

2. The automatic erasing device as defined in claim 1, wherein said lower axle is disposed over said water tank so that each of said eraser members is adapted to move into the water in said water tank when moved to be disposed under said lower axle.

3. The automatic erasing device as defined in claim 1, further comprising a water suction unit which includes:

a water tube disposed on said elongated housing and having a lower end that is adapted to extend into the water in said water tank and an upper end that is directed to said front route; and a pump disposed in said elongated housing and adapted to force the water from said water tank into said eraser members via said water tube while said eraser members move along said front route.

4. The automatic erasing device as defined in claim 1, further comprising a water removing member, which is disposed on said elongated housing and which abuts against said eraser members when said eraser members move along said front route, thereby removing a portion of the water from said eraser members.

* * * * *